US012338818B2

(12) United States Patent
Lepak et al.

(10) Patent No.: US 12,338,818 B2
(45) **Date of Patent: *Jun. 24, 2025**

(54) SCROLL COMPRESSOR WITH INTERMEDIATE INJECTION

(71) Applicant: TRANE INTERNATIONAL INC., Davidson, NC (US)

(72) Inventors: Derrick Lepak, Onalaska, WI (US); Scott J. Smerud, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 61 days.

This patent is subject to a terminal disclaimer.

(21) Appl. No.: 18/175,974

(22) Filed: Feb. 28, 2023

(65) Prior Publication Data

US 2024/0287985 A1 Aug. 29, 2024

(51) Int. Cl.
*F04C 18/02* (2006.01)
*F04C 2/02* (2006.01)
(Continued)

(52) U.S. Cl.
CPC ..... *F04C 2/025* (2013.01); *F04C 18/0207* (2013.01); *F04C 18/0246* (2013.01);
(Continued)

(58) Field of Classification Search
CPC .. F04C 2/025; F04C 18/0207; F04C 18/0246; F04C 18/0253; F04C 29/0007;
(Continued)

(56) References Cited

U.S. PATENT DOCUMENTS 6,017,203 A 1/2000 Sugawa et al.
6,193,485 B1 2/2001 Ueda et al.
(Continued)

FOREIGN PATENT DOCUMENTS

EP 3546755 A1 10/2019
KR 0113417 Y1 * 2/1993 ..... F04C 29/042
WO 2009/041390 A1 4/2009

OTHER PUBLICATIONS

KR 0113417 by PE2E Sep. 25, 2024.*
Extended European Search Report issued in European Patent Application No. 24160387.7, Jun. 28, 2024 (9 pages).

*Primary Examiner* — Deming Wan
(74) *Attorney, Agent, or Firm* — HSML P.C.

(57) ABSTRACT

A scroll compressor includes a compressor housing containing an orbiting scroll member, a non-orbiting scroll member, a pair of bands disposed between the non-orbiting scroll member and the compressor housing, a suction chamber, a discharge chamber, and an intermediate injection chamber defined by the pair of bands. The non-orbiting scroll member includes an intermediate injection port fluidly connecting the intermediate injection chamber to at least one compression pocket formed by the intermeshed scroll members. A heating, ventilation, air conditioning, and refrigeration system including a refrigerant circuit with a condenser, at least one expander, an evaporator, and the scroll compressor fluidly connected. A method of making a scroll compressor includes placing an upper portion of a compressor housing over a non-orbiting scroll member with bands disposed therebetween, and interference fitting the upper portion onto the non-orbiting scroll member via the bands.

19 Claims, 9 Drawing Sheets

(51) Int. Cl.
*F04C 29/00* (2006.01)
*F04C 29/04* (2006.01)
*F25B 31/02* (2006.01)

(52) U.S. Cl.
CPC ..... *F04C 18/0253* (2013.01); *F25B 31/026* (2013.01); *F04C 2230/60* (2013.01); *F04C 2240/30* (2013.01)

(58) Field of Classification Search
CPC .... F04C 29/042; F04C 29/004; F04C 29/005; F04C 29/008
See application file for complete search history.

(56) References Cited

U.S. PATENT DOCUMENTS

| | | | | |
|---|---|---|---|---|
| 11,408,421 | B2 | 8/2022 | Ma et al. | |
| 2008/0078192 | A1 | 4/2008 | Ignatiev et al. | |
| 2010/0008807 | A1* | 1/2010 | Roof | F04C 23/008 418/55.1 |
| 2020/0141408 | A1 | 5/2020 | Ma et al. | |
| 2020/0408209 | A1 | 12/2020 | Lepak et al. | |
| 2024/0060493 | A1* | 2/2024 | Gossen | F04C 27/004 |

* cited by examiner

SCROLL COMPRESSOR WITH INTERMEDIATE INJECTION

FIELD

This disclosure relates to scroll compressors with intermediate injection. More Specifically, this disclosure relates to providing intermediate injection into a scroll compressor in heating, ventilation, air conditioning, and refrigeration (HVACR) systems.

BACKGROUND

A scroll compressor is a type of compressor used to compress a gas. Heating, ventilation, air conditioning, and refrigeration systems ("HVACR") may utilize compressors to compress a gaseous working fluid. One type of compressor is a scroll compressor which generally includes a pair of scroll members which orbit relative to each other to compress gas (e.g., air, refrigerant, or the like). Typically, a scroll compressor includes a first, fixed scroll member with a generally spiral wrap and a second, orbiting scroll member with a generally spiral wrap. The spiral wraps of the two scroll members are intermeshed, creating a series of compression pockets. The second, orbiting scroll member is driven by a rotating shaft to orbit the first, stationary scroll member by a rotating shaft causing gas to be compressed within the compression pockets.

SUMMARY

In an embodiment, a scroll compressor includes a compressor housing, a plurality of chambers disposed in the compressor housing, an orbiting scroll member, and a non-orbiting scroll member, and a first band and a second band disposed within the compressor housing. The plurality of chambers includes a suction chamber, a discharge chamber, and an intermediate injection chamber. The orbiting scroll member and the non-orbiting scroll member are intermeshed to form compression pockets within the compressor housing. The compression pockets are configured to suction from the suction chamber and discharge into the discharge chamber. The non-orbiting scroll member includes an intermediate injection port that fluidly connects the intermediate injection chamber to at least one of the compression pockets. The first band and the second band each extend between the non-orbiting scroll member and the compressor housing. The intermediate injection chamber is defined by the first band and the second band.

In an embodiment, the first band forms a seal between the intermediate injection chamber and the discharge chamber, and the second band forms a seal between the intermediate injection chamber and the suction chamber.

In an embodiment, the first band and the second band each extend from the non-orbiting scroll member to the compressor housing.

In an embodiment, the compressor includes a suction inlet, an intermediate injection inlet, and a discharge outlet in the compressor housing. The suction chamber fluidly connects the suction inlet to an inlet of the compression pockets. The discharge chamber fluidly connects an outlet of the compression pockets to the discharge outlet. The intermediate injection chamber fluidly connects the intermediate injection inlet to an intermediate injection port in the non-orbiting scroll member.

In an embodiment, the intermediate injection chamber encircles the non-orbiting scroll member.

In an embodiment, the first band and the second band each encircle the non-orbiting scroll member.

In an embodiment, the intermediate injection chamber has an annular shape.

In an embodiment, the compressor housing includes an upper portion and a lower portion. The first band extends from the non-orbiting scroll member to the upper portion of the compressor housing. The intermediate injection chamber is defined by the upper portion of the compressor housing.

In an embodiment, the upper portion of the compressor housing is shrink fitted onto the non-orbiting scroll member via the first band and the second band.

In an embodiment, the first band contacts the compressor housing and the non-orbiting scroll member.

In an embodiment, a heating, ventilation, air conditioning, and refrigeration (HVACR) system includes a refrigerant circuit. The refrigerant circuit includes a condenser, at least one expander, an evaporator, and a scroll compressor that are fluidly connected. A working fluid flows through the refrigerant circuit. The scroll compressor includes a compressor housing, a plurality of chambers disposed in the compressor housing, an orbiting scroll member, and a non-orbiting scroll member, and a first band and a second band disposed within the compressor housing. The plurality of chambers includes a suction chamber, a discharge chamber, and an intermediate injection chamber. The orbiting scroll member and the non-orbiting scroll member are intermeshed to form compression pockets within the compressor housing. The compression pockets are configured to suction from the suction chamber and discharge into the discharge chamber. The non-orbiting scroll member includes an intermediate injection port that fluidly connects the intermediate injection chamber to at least one of the compression pockets. The first band and the second band each extend between the non-orbiting scroll member and the compressor housing. The intermediate injection chamber is defined by the first band and the second band.

In an embodiment, the first band forms a seal between the intermediate injection chamber and the discharge chamber, and the second band forms a seal between the intermediate injection chamber and the suction chamber.

In an embodiment, the first band and the second band each extend from the non-orbiting scroll member to the compressor housing.

In an embodiment, the compressor includes a suction inlet, an intermediate injection inlet, and a discharge outlet in the compressor housing. The suction chamber fluidly connects the suction inlet to an inlet of the compression pockets. The discharge chamber fluidly connects an outlet of the compression pockets to the discharge outlet. The intermediate injection chamber fluidly connects the intermediate injection inlet to an intermediate injection port in the non-orbiting scroll member.

In an embodiment, the intermediate injection chamber encircles the non-orbiting scroll member.

In an embodiment, the first band and the second band each encircle the non-orbiting scroll member.

In an embodiment, a method is directed to making a scroll compressor. The method includes placing an upper portion of a compressor housing over a non-orbiting scroll member. The upper portion of the compressor housing surrounding the non-orbiting scroll member, and a first band and a second band are each disposed between the upper portion of the compressor housing and the non-orbiting scroll member. The method also includes interference fitting the upper portion of the compressor housing onto the non-orbiting scroll member via the first band and the second band. The interference fitting forms an intermediate injection chamber that is defined by the first band, the second band, the upper portion of the compressor housing, and the non-orbiting scroll member. The intermediate injection chamber fluidly connects an intermediate injection inlet in the compressor housing to an intermediate injection port in the non-orbiting scroll member.

In an embodiment, the method also includes heating of the upper portion of the compressor housing, prior to placing the upper portion of the compressor housing over the non-orbiting scroll member. The interference fitting is a shrinking fitting that includes cooling of the upper portion of the compressor housing, which results in the upper portion of the compressor housing being shrink fit onto the non-orbiting scroll member via the first band the second band. The first band and the second band being shrink bands.

In an embodiment, the scroll compressor includes a non-orbiting scroll member intermeshed with the non-orbiting scroll member to form compression pockets. The interference fitting forms a discharge chamber that fluidly connects an outlet of the compression pockets to the discharge outlet.

DRAWINGS

Like numbers represent like features.

DETAILED DESCRIPTION

Figure 1A:
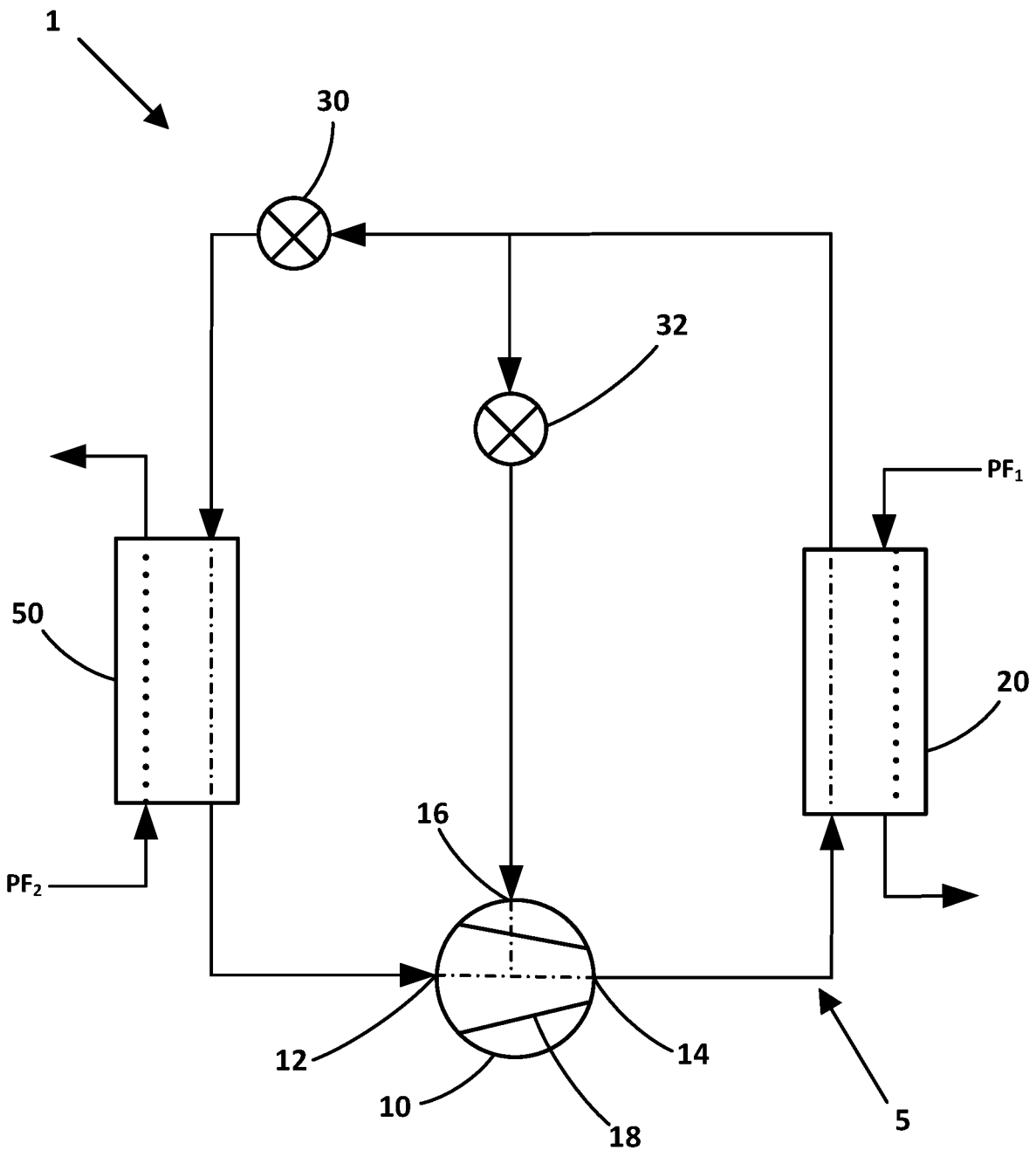
FIG. 1A is a schematic diagram of an embodiment of a refrigerant circuit in a heating, ventilation, air conditioning, and refrigeration (HVACR) system.

FIG. 1 is a schematic diagram of an embodiment of a refrigerant circuit 5 in a heating, ventilation, air conditioning, and refrigeration (HVACR) system 1. In an embodiment, the HVACR system 1 may be an industrial, commercial, or residential HVACR system 1 configured to condition the inside of a building (e.g., office space, residential house, or the like). In an embodiment, the HVACR system 1 may be a transport HVACR used for cooling the inside of a transport unit (e.g., shipping container, transport/trucking container, reefer, or the like) and/or a passenger vehicle (e.g., a bus, a plane, or the like).

The refrigerant circuit 5 includes a compressor 10, a condenser 20, a first expansion device 30, a second expansion device 32, and an evaporator 50 that are fluidly connected. In an embodiment, the refrigerant circuit 5 can be modified to include additional components. For example, the refrigerant circuit 5 in an embodiment can include one or more flow control devices, a receiver tank, a dryer, a suction-liquid heat exchanger, or the like. The components of the refrigerant circuit 5 are fluidly connected. Dotted lines and dotted-dashed lines are provided in FIGS. 1A-1C to indicate fluid flows through some components (e.g., compressor 10, condenser 20, evaporator 50) for clarity, and should be understood as not specifying a specific route within each component.

The refrigerant circuit 5 can be configured as a cooling system (e.g., a fluid chiller of an HVACR, an air conditioning system, or the like) that can be operated in a cooling mode, and/or the refrigerant circuit 5 can be configured to operate as a heat pump system that can run in a cooling mode and a heating mode.

The refrigerant circuit 5 applies known principles of gas compression and heat transfer. The refrigerant circuit 5 can be configured to heat or cool a process fluid (e.g., water, air, chiller fluid, or the like). In an embodiment, the refrigerant circuit 5 may represent a chiller that cools a process fluid such as water or the like. In an embodiment, the refrigerant circuit 5 may represent an air conditioner and/or a heat pump that cools and/or heats a process fluid such as air, water, or the like.

During the operation of the refrigerant circuit 5, a working fluid (e.g., containing refrigerant, a refrigerant mixture, or the like) flows into the compressor 10 from the evaporator 50 in a gaseous state at a relatively lower pressure. The compressor 10 compresses the gaseous working fluid into a high pressure state, which also heats the gas. The compressor 10 includes a suction inlet 12, a discharge outlet 14, an intermediate injection inlet 16, and a compression mechanism 18 configured to move within the compressor 10 to compress the gas into the high pressure state. The lower pressure gaseous working fluid flows from the evaporator 50 into the suction inlet 12 of the compressor 10 and is discharged from the discharge outlet 14 of the compressor 10 after being compressed by the compression mechanism 18. The working fluid flows from the suction inlet 12 into the compression mechanism 18 and then from the compression mechanism 18 to and out of the compressor 10 through the discharge outlet 14.

In an embodiment, the compressor 10 is a type that utilizes injection of intermediate pressure working fluid into the compression mechanism 18 (e.g., economizer injection or the like). In an embodiment, the compressor 10 is a scroll compressor and the compression mechanism 18 is a pair of intermeshed scroll members (e.g., intermediate pressure gaseous working fluid is injected into a formed intermediate compression pocket between the intermeshed scroll members). The intermediate pressure gaseous working fluid flows into the intermediate injection inlet 16 of the compressor 10, and from the intermediate injection inlet 16 into the compression mechanism 18. The intermediate pressure gaseous working fluid mixes with the gaseous working fluid being compressed within the compression mechanism 18 (e.g., mixes with the gaseous working fluid already partially compressed within the compression mechanism 18), is further compressed within the compression mechanism 18, and is then discharged from the compression mechanism 18 to and out of the compressor 10 through the discharge outlet 14.

After being compressed, the relatively higher pressure and higher temperature gaseous working fluid flows from the discharge outlet 14 of the compressor 10 to the condenser 20. The working fluid flows through the condenser 20. In addition to the working fluid flowing through the condenser 20, a first process fluid $PF_1$ (e.g., external air, external water, cooling/heater water, glycol, combinations thereof, or the like) also separately flows through the condenser 20. The first process fluid $PF_1$ absorbs heat from the working fluid as the first process fluid $PF_1$ flows through the condenser 20, which cools the working fluid as the working fluid flows through the condenser 20. The working fluid condenses to liquid within the condenser 20. The liquid working fluid then flows from the condenser 20 to the expansion devices 30, 32.

A first portion of the relatively cooler, relatively higher pressure liquid working fluid discharged from the condenser 20 flows from the condenser 20 into the first expansion device 30. A second portion of the relatively cooler, relatively higher pressure liquid working fluid discharged from the condenser 20 flows into the second expansion device 32. As shown in FIG. 1A, the first expansion device 30 and the second expansion device 32 are disposed in parallel downstream of the condenser 20.

The first expansion device 30 allows the working fluid to expand, which converts the working fluid to a mixed vapor and liquid state. The expansion also causing further cooling of the working fluid. An "expansion device" as described herein may also be referred to as an expander. In an embodiment, the expander may be an expansion valve, expansion plate, expansion vessel, orifice, or the like, or other such types of expansion mechanisms. It should be appreciated that the expander may be any type of expansion device used in the field for expanding a working fluid to cause the gaseous working fluid to decrease in pressure and temperature. The first expander 30 and the second expander 32 may be the same type of expansion device or may be different types of expansion devices. In an embodiment, one or both of the expanders 30, 32 are an adjustable type of expansion device. For example, the expanders 30, 32 may each be an expansion valve. For example, one or both of the expanders 30, 32 may be adjusted to control the amount of the working fluid that will flow into the suction inlet 12 and the intermediate injection inlet 16 of the compressor.

The further relatively lower temperature, vapor/liquid working fluid then flows from the second expander 32 into the evaporator 50. A second process fluid $PF_2$ (e.g., air, chiller liquid, water, glycol, combinations thereof, or the like) also flows through the evaporator 50. The working fluid absorbs heat from the second process fluid $PF_2$ as it flows through the evaporator 50, which cools the second process fluid $PF_2$ as it flows through the evaporator 50. As the working fluid absorbs heat, the working fluid evaporates to vapor. The gaseous/mostly gaseous working fluid then returns to the compressor 10 from the evaporator 50.

The second portion of the relatively cooler, relatively higher pressure liquid working fluid discharged from the condenser 20 flows to the second expander 32. The second expander 32 allows the working fluid to expand, which converts the working fluid to a vapor state. The expansion also causing further cooling of the working fluid. The relatively lower temperature, intermediate pressure gaseous working fluid then flows from the second expander 32 to the intermediate injection inlet 16 of the compressor 10.

The above-described process continues while the refrigerant circuit 5 is operated, for example, in a cooling mode. In an embodiment, the HVACR system 1 may include a controller (not shown) that controls operation of the expanders 30, 32. The controller may control the expanders 30, 32 (e.g., the degree each expansion valve is open) so that the desired amount (e.g., percentage, or the like) of the working fluid discharged from the condenser flows through the first expander 30 and the second expander 32.

Figure 1B:
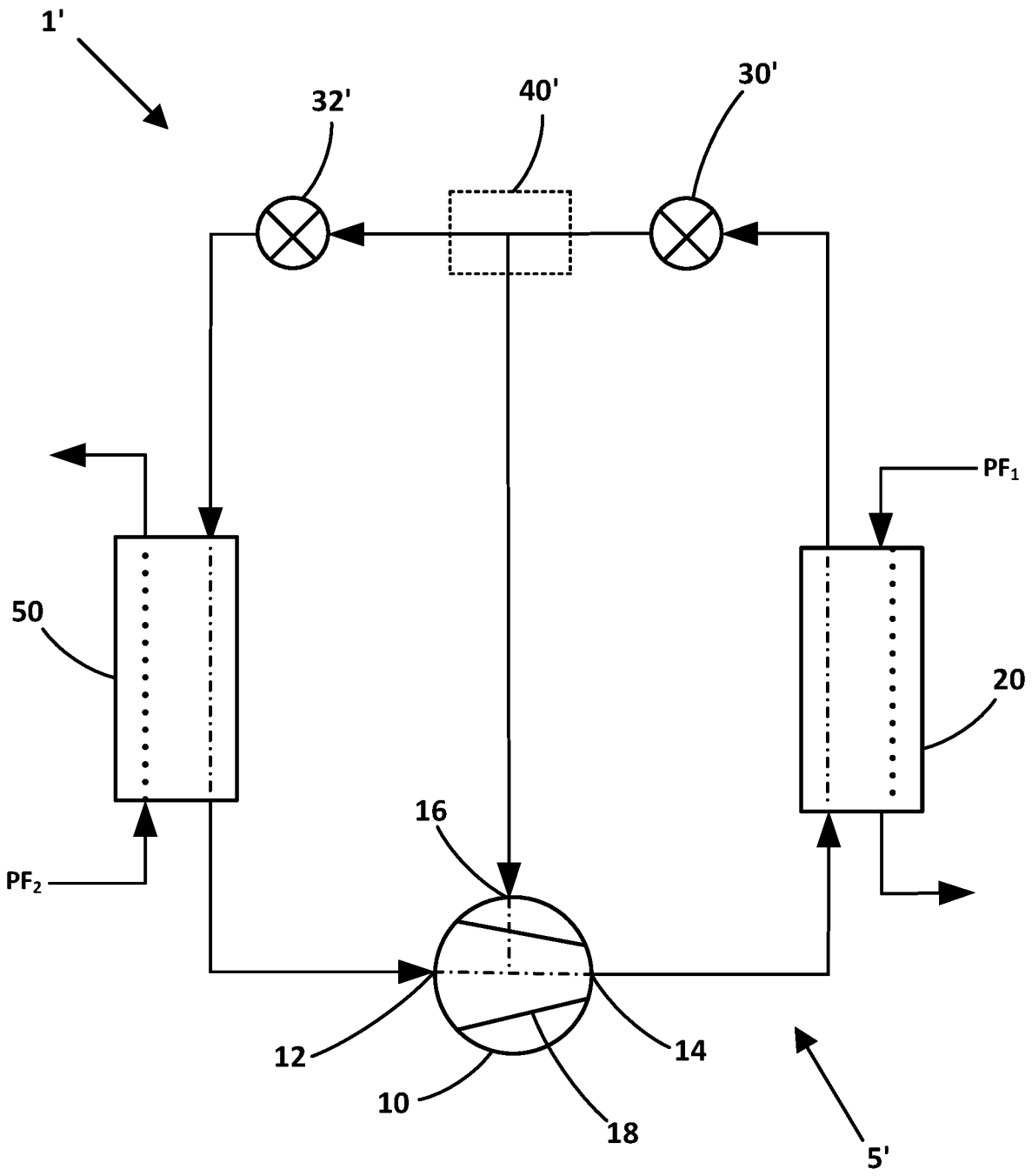
FIG. 1B is a schematic diagram of an embodiment of a refrigerant circuit in a HVACR system.

FIG. 1B is a schematic diagram of another embodiment of a refrigerant circuit 5' in a HVACR system 1'. The refrigerant circuit 5' includes similar components to the refrigerant circuit 5 in FIG. 1A, except for the position and configuration of the expanders 30', 32'. For example, the refrigerant circuit 5' includes a compressor 10, a condenser 20, a first expander 30', a second expander 32', and an evaporator 50 that are fluidly connected. Unless described otherwise, the refrigerant circuit 5' and its individual components operate in a similar manner to the refrigerant circuit 5 in FIG. 1A as described above. The refrigerant circuit 5' may be modified as similarly discussed above with respect to the refrigerant circuit 5 in FIG. 1 (e.g., to include additional components, or the like).

During the operation of the refrigerant circuit 5, the working fluid flows from the evaporator 50 into the suction inlet 12 of the compressor 10, is compressed and mixes with intermediate pressure working fluid within the compression mechanism 18, is discharged from the discharge outlet 14 of the compressor 10, and is then cooled/condensed within the condenser 20, as similarly discussed for the refrigerant circuit 5 in FIG. 1A.

The cooler, relatively higher pressure liquid working fluid discharged from the condenser 20 flows into the first expander 30'. The first expansion device 30' causes/allows the working fluid to partially expand, which converts the working fluid to a mixed vapor and liquid state. The working fluid also cools as it expands. A first portion of the relatively lower temperature, intermediate pressure working fluid (e.g., a liquid portion or a mixed vapor and liquid portion of the relatively lower temperature intermediate pressure working fluid) flows form the first expander 30' to the second expander 32'. A second portion of the relatively lower temperature, intermediate pressure working fluid (e.g., a gaseous portion of the relatively lower temperature intermediate pressure working fluid) flows from the first expander 30' to the intermediate injection inlet 16 of the compressor 10.

As shown in FIG. 1B, the first expander 30' and the second expander 32' are disposed in series downstream of the condenser 20. In an embodiment, the refrigerant circuit 5' may include an economizer 40 disposed between the first expander 30' and the second expander 32' (e.g., the first expander 32', the economizer 40, and the second expander 32' disposed in series downstream of the condenser 20). In the illustrated embodiment, the economizer 40 is a liquid/gas separator. The first portion of the relatively lower temperature, intermediate pressure working fluid flows from the economizer 40 to the second expander 32', and the second portion of the relatively lower temperature, intermediate pressure working fluid flows from the economizer to the intermediate injection inlet 16 of the compressor 10. The economizer 40 can be configured to ensure that the second portion of intermediate pressure working fluid flowing to intermediate injection inlet 16 of the compressor 10 is in a gaseous state.

The first portion of intermediate pressure working fluid is further expanded by the expander 32', which causes liquid in the first portion to become gaseous. This also causes further cooling of the working fluid. The further relatively lower temperature, vapor/liquid working fluid then flows from the second expander 32' into the evaporator 50. As similarly discussed above for the refrigerant circuit 5 in FIG. 1A, the working fluid then cools a process fluid $PF_2$ within the evaporator 50, and then flows from the evaporator 50 back to the compressor 10.

Figure 1C:
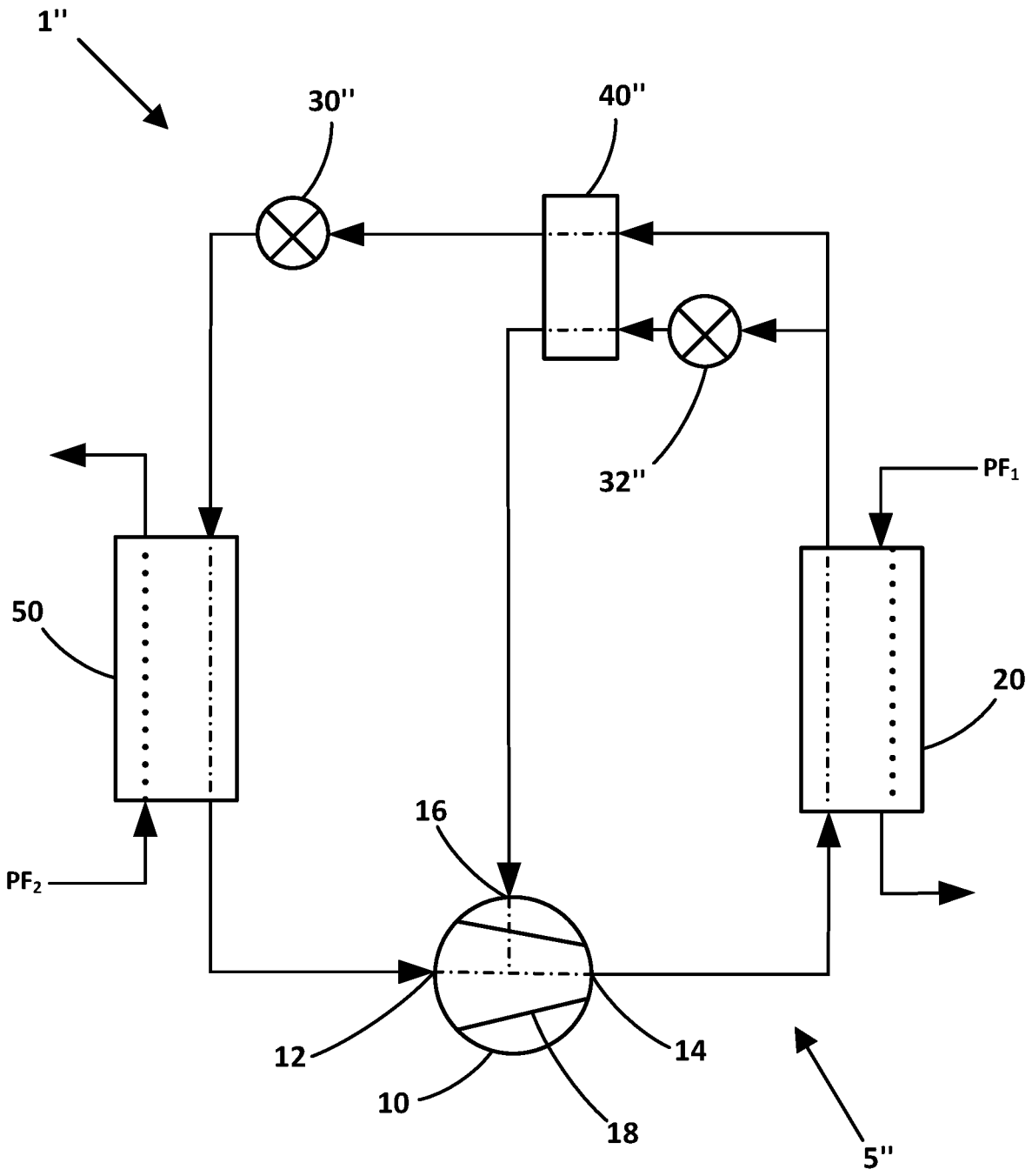
FIG. 1C is a schematic diagram of an embodiment of a refrigerant circuit in a HVACR system.

FIG. 1C is a schematic diagram of another embodiment of a refrigerant circuit 5" in a HVACR system 1". The refrigerant circuit 5" includes similar components to the refrigerant circuit 5 in FIG. 1A, except for the inclusion of an economizer 40". For example, the refrigerant circuit 5" includes a compressor 10, a condenser 20, a first expander 30", a second expander 32", an economizer 40", and an evaporator 50 that are fluidly connected. Unless described otherwise, the refrigerant circuit 5" operates in a similar manner to the refrigerant circuit 5 in FIG. 1A as described above. The refrigerant circuit 5" may be modified as similarly discussed above with respect to the refrigerant circuit 5 in FIG. 1 (e.g., to include additional components, or the like).

During the operation of the refrigerant circuit 5", the working fluid flows from the evaporator 50 into the suction inlet 12 of the compressor 10, is compressed and mixes with intermediate pressure working fluid within the compression mechanism 18, is discharged from the discharge outlet 14 of the compressor 10, and is then cooled/condensed within the condenser 20, as similarly discussed for the refrigerant circuit 5 in FIG. 1A. As shown in FIG. 1C, the expanders 30", 32" are disposed in parallel downstream of the condenser 20.

A first portion of the liquid working fluid discharged from the condenser 20 flows through the economizer 40" to a first expander 30". A second portion of the liquid working fluid discharged from the condenser 20 flows through a second expander 32" and the economizer 40" to the intermediate injection inlet 16 of the compressor 10. The first expansion device 30" causes/allows the working fluid to partially expand, which converts the working fluid to a gas state or to a vapor and liquid mixed state. The relatively cooler, intermediate pressure working fluid then flows from the second expander 32" to the economizer 40".

In the illustrated embodiment, the economizer 40" is a heat exchanger that allows the first portion of working fluid and the second portion of working fluid to exchange heat without physically mixing. As both portions of the working fluid flow through the economizer 40", the relatively cooler, intermediate pressure working fluid (i.e., the second portion of the working fluid) absorbs heat from the first portion of the working fluid. In an embodiment, this may also convert liquid in the second portion into gaseous working fluid. The gaseous intermediate pressure working fluid (i.e., the second portion of the working fluid) then flows from the economizer 40" to the intermediate injection inlet 16 of the compressor 10.

The first portion of working fluid is cooled within the economizer 40" and then flows from the economizer 40" to the first expander 30". The cooled first portion of working fluid is then expanded by the expander 32", which causes liquid in the first portion to become gaseous. This also causes further cooling of the working fluid. The further relatively lower temperature, vapor/liquid working fluid then flows from the first expander 30" into the evaporator 50. As similarly discussed above for the refrigerant circuit 5 in FIG. 1A, the working fluid then cools a process fluid $PF_2$ within the evaporator 50, and then flows from the evaporator 50 back to the compressor 10.

Figure 1D:
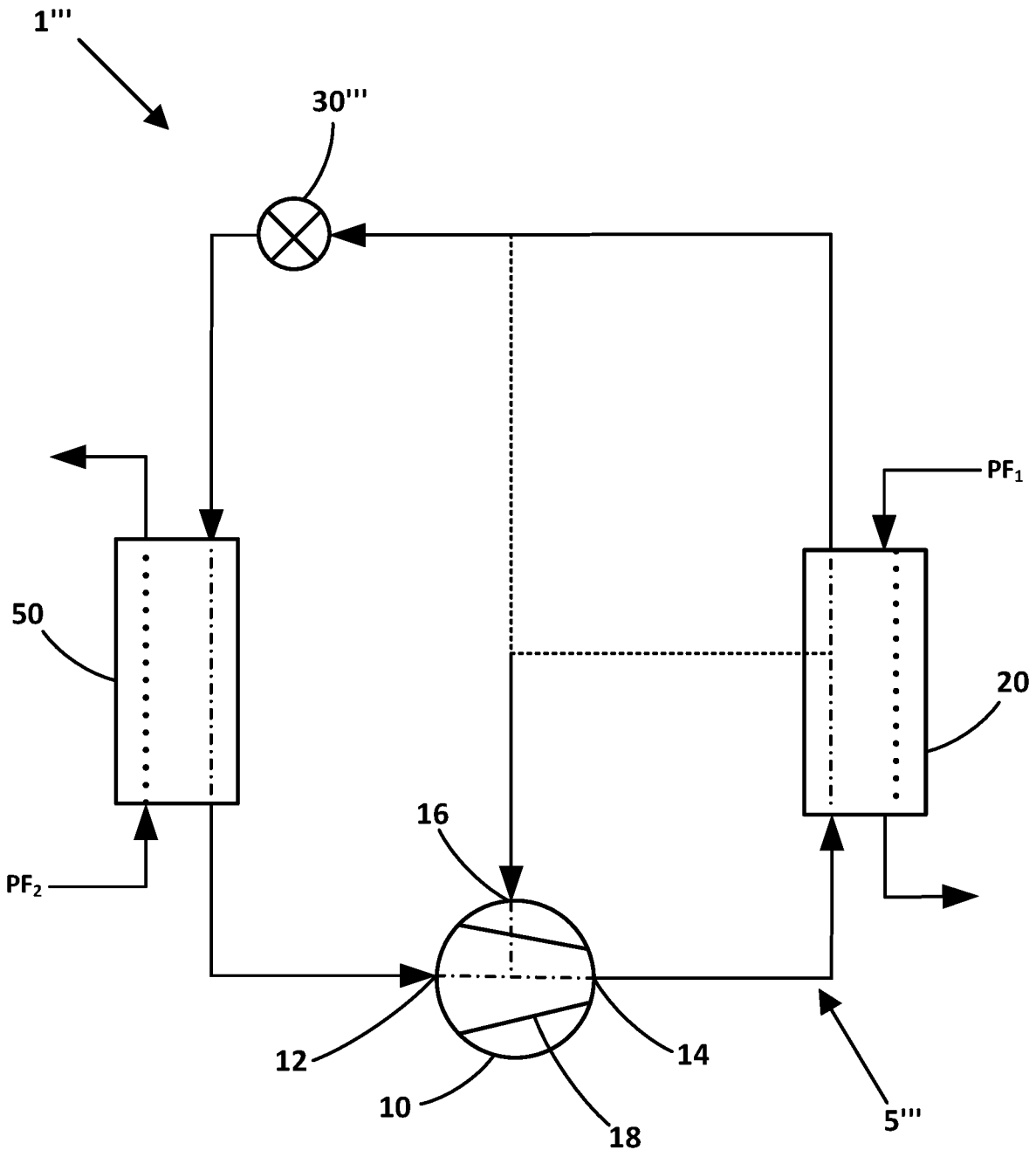
FIG. 1D is a schematic diagram of an embodiment of a refrigerant circuit in a HVACR system.

FIG. 1D is a schematic diagram of another embodiment of a refrigerant circuit 5'" in a HVACR system 1'". The refrigerant circuit 5'" includes similar components to the refrigerant circuit 5 in FIG. 1A, except for not including the second expander 32. For example, the refrigerant circuit 5'" includes a compressor 10, a condenser 20, a first expander 30'", and an evaporator 50 that are fluidly connected. Unless described otherwise, the refrigerant circuit 5'" operates in a similar manner to the refrigerant circuit 5 in FIG. 1A as described above. The refrigerant circuit 5'" may be modified as similarly discussed above with respect to the refrigerant circuit 5 in FIG. 1 (e.g., to include additional components, or the like).

During the operation of the refrigerant circuit 5'", the working fluid flows from the evaporator 50 into the suction inlet 12 of the compressor 10, is compressed and mixes with injected working fluid from the intermediate inlet 16 within the compression mechanism 18, is discharged from the discharge outlet 14 of the compressor 10, and is then cooled/condensed within the condenser 20, as similarly discussed for the refrigerant circuit 5 in FIG. 1A. As discussed below, the working fluid flowing into the compressor 10 through the intermediate inlet 16 and injected into the compression mechanism 18 contains liquid working fluid (e.g., is liquid working fluid, is a mixed phase liquid and vapor liquid working fluid).

A first portion of the liquid working fluid condensed in the condenser 20 flows to the expander 30'". The expander 30'" causes/allows the working fluid to partially expand, which converts the working fluid to a gas state or to a vapor and liquid mixed state. The relatively lower temperature, vapor/liquid working fluid then flows from the expander 30'" into the evaporator 50. As similarly discussed above for the refrigerant circuit 5 in FIG. 1A, the working fluid then cools a process fluid $PF_2$ within the evaporator 50, and then flows from the evaporator 50 back to the compressor 10.

A second portion of the liquid working fluid flows from the condenser 20 to the intermediate injection inlet 16 of the compressor 10. As shown in FIG. 1D, the second portion of liquid working fluid may be provided separately from the condenser 20 or may be provided from liquid working fluid discharged of the condenser 20 (e.g., from the working fluid as it flows from the condenser 20 to the expander 30'").

In FIG. 1D, the liquid working fluid is at the discharge pressure of the compressor. In an embodiment, the liquid working fluid may be an intermediate pressure liquid portion of the working fluid (e.g., refrigerant circuit 5 in FIG. 1A in which the second expander 32 discharges a mixed liquid and vapor intermediate pressure working fluid, refrigerant circuit 5' in FIG. 1B in which intermediate liquid working fluid or a mixed liquid and vapor intermediate pressure working fluid is supplied to the intermediate injection inlet 16 of the compressor 10, or the like). The injection of liquid working fluid can provide cooling to the compressor 10. In one example, the liquid working fluid evaporates within the compressor 10 (e.g. within the compression mechanism 18) which provides cooling to the compressor 10.

Figure 2:
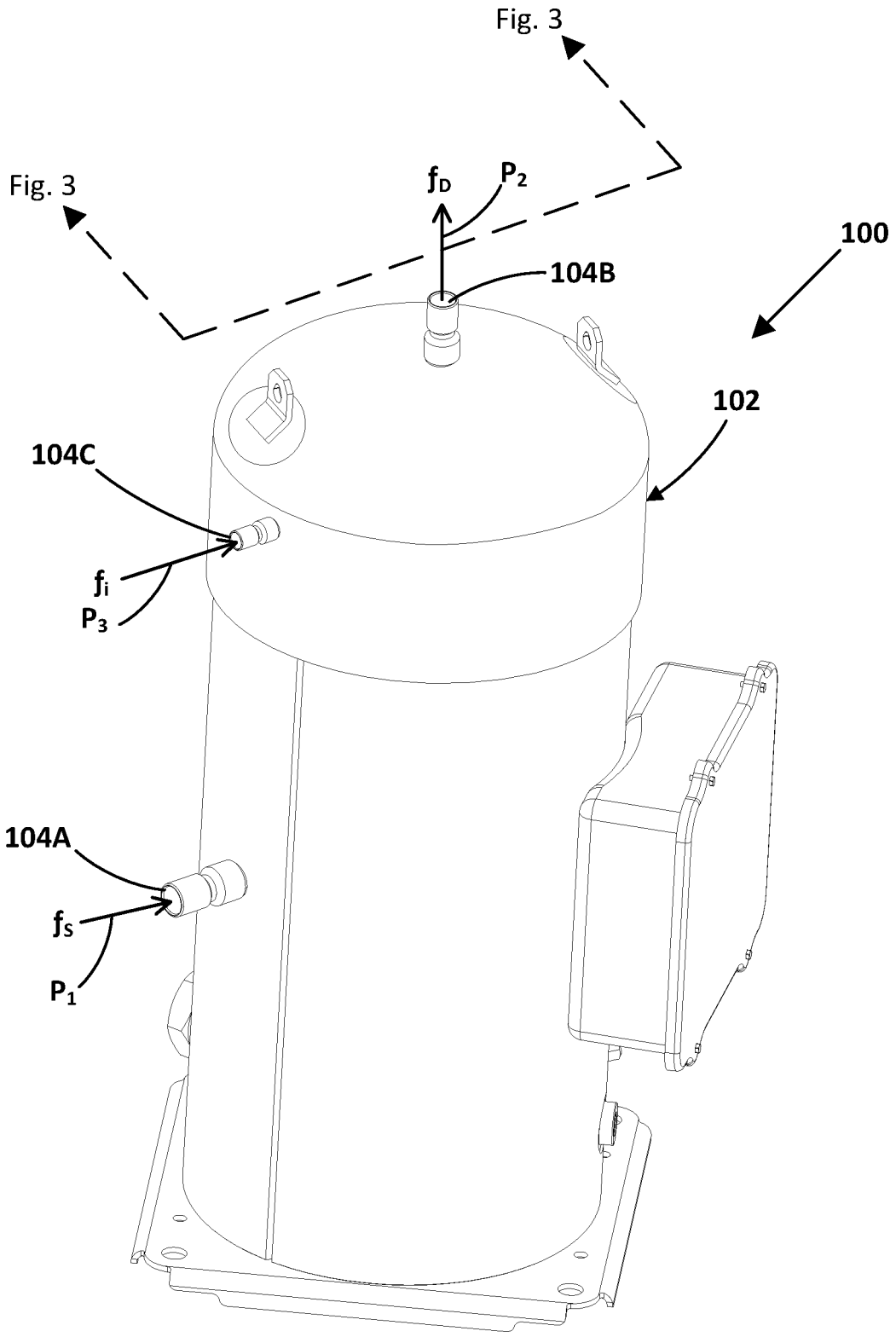
FIG. 2 is a front perspective view of an embodiment of a scroll compressor.

FIG. 2 is a front perspective view of a scroll compressor 100, according to an embodiment. In an embodiment, the scroll compressor may be the compressor 10 in the refrigerant circuit 5 in FIG. 1A, in the refrigerant circuit 5' in FIG. 1B, in the refrigerant circuit 5" in FIG. 1C, or in the refrigerant circuit 5'" in FIG. 1D. The compressor 100 includes a compressor housing 102 that contains components of the compressor 100. As shown in FIG. 2, the compressor housing 102 is the outer housing of the compressor 100.

The compressor 100 includes a plurality of fluid ports that extend through the housing 102 for supplying working fluid into and discharging working fluid from the compressor 100. The working fluid enters and exits the compressor 100 by flowing through the fluid ports in the housing 102. The fluid ports include a suction inlet 104A, a discharge outlet 104B, and an intermediate injection inlet 104C. A suction flow $f_S$ of the working fluid to be compressed flows into the compressor 100 though the suction inlet 104A in the housing 102 at a relatively lower pressure (e.g., at a first pressure $P_1$). A discharge flow $f_D$ of the compressed working fluid is discharged from the discharge outlet 104B of the compressor 100 at a relatively higher pressure (e.g., at a second pressure $P_2$ greater than the first pressure $P_1$). An intermediate flow $f_i$ of the working fluid flows into the compressor 100 through the intermediate injection inlet 104C in the housing 102. This flow $f_i$ can also be referred to as economizer injection, intermediate injection flow, or economizer injection flow. The intermediate injection working fluid in the flow $f_i$ may be a liquid working fluid at the relatively higher pressure or a working fluid at an intermediate pressure (e.g., at a third pressure $P_3$ greater than the first pressure $P_1$ and less than the second pressure $P_2$). For example, the working fluid at the intermediate pressure can be a gaseous working fluid at the intermediate pressure or a mixed phase liquid and vapor working fluid at the intermediate pressure.

In one example, the intermediate injection working fluid is at the intermediate pressure. In an embodiment, the intermediate pressure working fluid is a gaseous working fluid. In an embodiment, the intermediate pressure working fluid may be a liquid working fluid or a mixed phase liquid and vapor working fluid. For example, the intermediate injection working fluid is an intermediate pressure working fluid supplied from an expander in the refrigerant circuit of the compressor 100 (e.g., from the second expander 32 in FIG. 1A, from the first expander 30' in FIG. 1B, from the second expander 32" in FIG. 1C) to the intermediate injection inlet 106C of the compressor 100. For example, the intermediate injection working fluid in the flow $f_i$ is a portion of the compressed working fluid in the discharge flow $f_D$ after being cooled in a condenser in the refrigerant circuit of the compressor 100 (e.g., condenser 20 in each of FIGS. 1A-1C) and then expanded by the expander in the refrigerant circuit of the compressor 100. For example, the relatively lower pressure working fluid in the suction flow $f_S$ is a different portion of the working fluid in the discharge flow that is supplied to the suction inlet 104A after being cooled in the condenser, further expanded by a different expander in the refrigerant circuit (e.g., by the first expander 30 in FIG. 1A, by the second expander 32' in FIG. 1B, by the first expander 30" in FIG. 1C), and then heated in an evaporator in the refrigerant circuit of the compressor 100 (e.g., evaporator 50 in FIGS. 1A-1C).

In one example, the intermediate injection working fluid can be a liquid working fluid at the relatively higher pressure. For example, the liquid intermediate injection working fluid is a portion of the liquid working fluid provided from a condenser (e.g., directly from the condenser or as the liquid working fluid flows from the condenser to an expander) of the refrigerant circuit of the compressor 100 (e.g., from the condenser 20 in FIG. 1D). For example, the intermediate injection working fluid in the flow $f_i$ is a portion of the compressed working fluid in the discharge flow $f_D$ after being cooled in a condenser in the refrigerant circuit of the compressor 100 (e.g., condenser 20 in FIG. 1D) and prior to being expanded by the expander (e.g., expander 30'" in FIG. 1D) in the refrigerant circuit of the compressor 100. For example, the relatively lower pressure working fluid in the suction flow $f_S$ is a different portion of the working fluid in the discharge flow that is supplied to the suction inlet 104A after being cooled in the condenser, expanded by the expander in the refrigerant circuit, and then heated in an evaporator in the refrigerant circuit of the compressor 100 (e.g., evaporator 50 in FIG. 1D).

Figure 3:
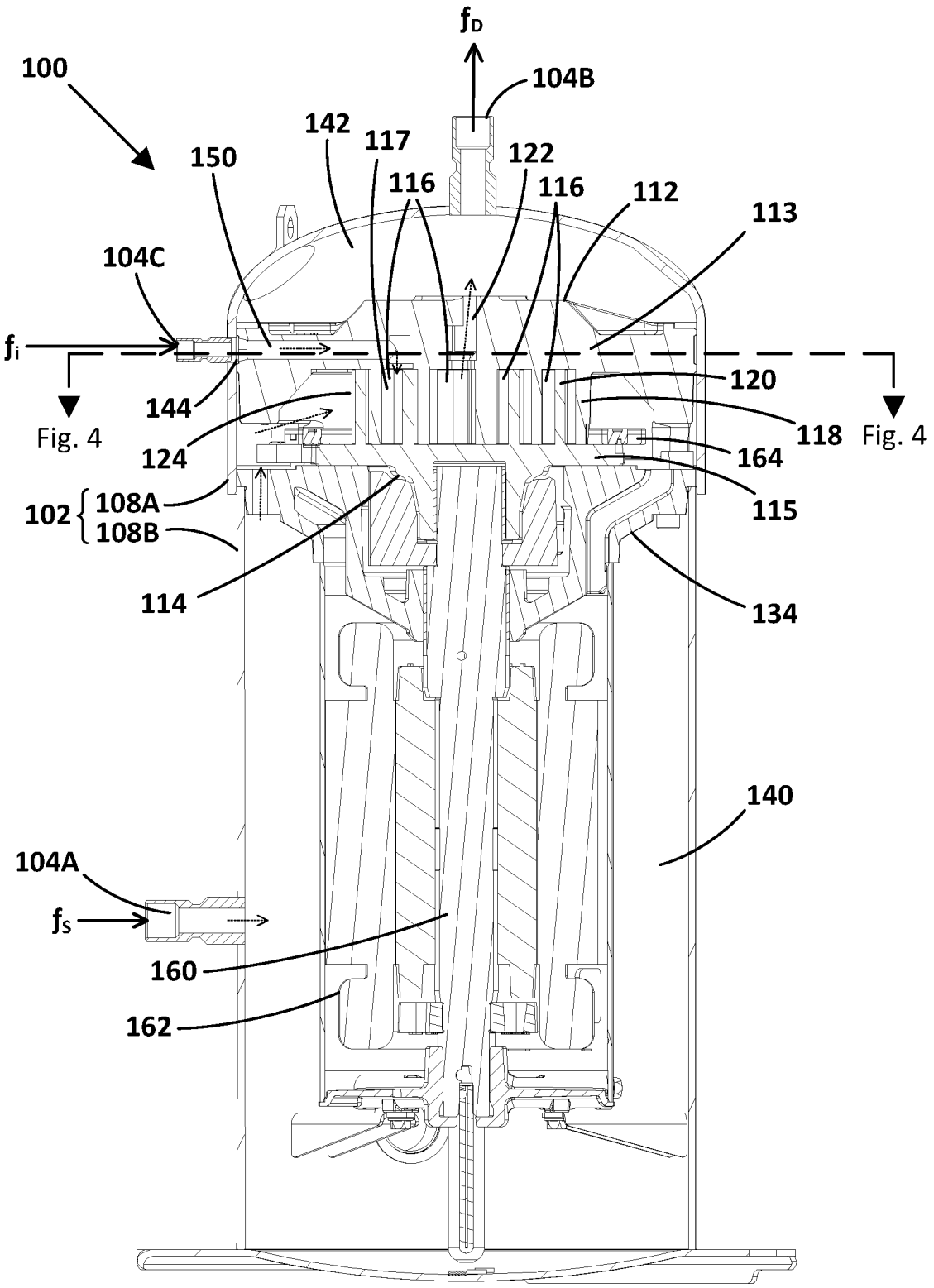
FIG. 3 is a vertical cross-sectional view of the scroll compressor as indicated in FIG. 2, according to an embodiment.

FIG. 3 is a cross-sectional view of the scroll compressor 100 in FIG. 2, according to an embodiment. The view in FIG. 3 is a vertical cross-sectional view of the scroll compressor 100, as indicated in FIG. 2. Dashed arrows are provided in FIG. 3 to indicate the flow of working fluid within the scroll compressor 100. As described above, the lower pressure fluid working fluid in the suction flow $f_S$ (i.e., the working fluid to be compressed) flows into the scroll compressor 100 through the suction inlet 104A, the higher pressure (compressed) working fluid in discharge flow $f_D$ is discharged from the compressor 100 through the discharge outlet 104B, and the intermediate/higher pressure working fluid in the injection flow $f_i$ flows into the compressor 100 through the intermediate injection inlet port 104C.

The illustrated compressor 100 is a single-stage scroll compressor. More specifically, the illustrated compressor 100 is a single-stage vertical scroll compressor. It is to be appreciated that the principles described herein are not limited to single-stage scroll compressors and can be applied to multi-stage scroll compressors having two or more compression stages. The embodiments are described herein for a compressor with a vertical or a near vertical crankshaft (e.g., as shown in FIG. 3). In other embodiments, the concepts described herein for the compressor 100 may be applied and/or adapted to a compressor with a non-vertical or a horizontal crankshaft. In such embodiments, it should be appreciated that relative spatial terms used herein, such but not limited to "upper", "lower", "vertical", "horizontal", would be interpreted with the compressor being positioned with its crankshaft in a vertical position.

The scroll compressor 100 includes a non-orbiting scroll member 112 and an orbiting scroll member 114. Applying known aspects of scroll compressor compression, the scroll compressor 100 utilizes the intermeshing of the two scroll members 112, 114 to form a plurality of compression pockets 116 in which gas is trapped and then compressed. The non-orbiting scroll 112 has a baseplate 113 and a spiral wrap 118 that projects from the baseplate 113 in a direction towards the orbiting scroll member 114. The orbiting scroll member 114 has a baseplate 115 and a spiral wrap 120 that projects from the baseplate 115 in a direction towards the non-orbiting scroll member 112. The spiral wrap 118 of the non-orbiting scroll 112 is intermeshed with the spiral wrap 120 of the orbiting scroll member 114 forming the compression pockets 116 there between. In an embodiment, the axial end of one or both of the spiral wraps 118, 120 may include a tip seal (not shown) to help encourage sealing between each spiral wraps 118, 120 and the opposing baseplate 113, 115.

The non-orbiting scroll member 112 is a scroll member that is in a fixed position within the compressor housing 102 and is not configured to be moved (e.g., orbited, rotated) relative to the compressor housing 102 during the operation of the scroll compressor 100. The non-orbiting scroll member 112 may be referred to as a non-orbiting scroll, a fixed scroll, a stationary scroll, a first scroll member, or the like. In an embodiment, the non-orbiting scroll 112 can be directly attached to the compressor housing 102 of the scroll compressor 100. For example, in the illustrated embodiment, the non-orbiting scroll 112 is interference fit into the compressor housing 102. This fit between the non-orbiting scroll 112 and the housing 102 is discussed in more detail below.

The orbiting scroll member 114 is a scroll member engaged with an end of a crankshaft 160. During operation of the scroll compressor 100, the orbiting scroll member 114 is moved (e.g., orbited, rotated) relative to the non-orbiting scroll member 112. The orbiting scroll member 114 is configured to be moved relative to the compressor housing 102 during operation of the compressor 100. The orbiting scroll member 114 may also be referred to as an orbiting scroll, a moving scroll, a second scroll member, or the like.

The orbiting scroll 114 is moved (e.g. orbited, rotated) by the crankshaft 160. As the orbiting scroll member 114 is engaged with the end of the crankshaft 160, rotation of the crankshaft 160 causes the moving of the orbiting scroll 114. The crankshaft 160 can be rotated by, for example, an electric motor 162. The electric motor 162 includes a rotor and a stator. The rotor and the crankshaft 160 are affixed together such that they rotate together (e.g., the rotor and the crankshaft 162 can be affixed together using an interference fit or other type of fit). The electric motor 162 may operate using known principles to rotate the crankshaft 160. In an embodiment, the crankshaft 160 may be rotated by other mechanisms other than the electric motor 162, such as, for example, an external electric motor, an external combustion engine, or other such mechanisms. Accordingly, such embodiments may not include the electric motor 162 as shown in FIG. 3. The scroll compressor 100 may include an alignment coupler for maintaining alignment of the intermeshed scrolls 112, 114, such as an Oldham coupling 164.

The compressor 100 includes a bearing support 134. The bearing support 134 can be affixed to the housing 102 and/or the non-orbiting scroll 112. The orbiting scroll 114 is disposed between the non-orbiting scroll 112 and the bearing support 134. The bearing support 134 can provide bearing(s)/bearing surface(s) for supporting the orbiting scroll 114 (e.g., a thrust bearing for axially supporting the orbiting scroll 114, or the like) and/or for supporting the crankshaft 160 (e.g., radial bearings for radially supporting the crankshaft 160, or the like).

The compressor housing 102 of the scroll compressor 100 includes an upper portion 108A and a lower portion 108B. As shown in FIG. 3, the suction inlet 104A extends through the lower portion 108B of the compressor housing 102. The intermediate injection inlet 104C extends through the upper portion 108B of the compressor housing 102. The discharge outlet 104B also extends through the upper portion 108B of the compressor housing 102. In the illustrated embodiment, the upper portion 108A is the uppermost portion of the compressor housing 102 and the lower portion 108B is the lowermost portion of the compressor housing 102. In other embodiments, the upper portion 108A may not be the uppermost portion of the housing 102 and/or the lower portion 108B may not be the lowermost portion of the compressor housing 102. In such embodiments, the intermediate injection inlet 104B and the discharge outlet 104C may extends through different portions of the compressor housing 102. As shown in FIG. 3, the upper portion 108A can be a cap of the scroll compressor housing 102.

The compressor housing 102 contains an internal volume that includes a suction chamber 140, a discharge chamber 142, and an intermediate injection chamber 144 of the compressor 100. The discharge chamber 142, the suction chamber 140, and the intermediate injection chamber 144 are at different pressures. For example, the suction chamber 140 is at the suction pressure (e.g., the first pressure $P_1$), the discharge chamber 142 is at the discharge pressure (e.g., the second pressure $P_2$), and the intermediate injection chamber 144 is at the discharge pressure or the intermediate pressure (e.g., the third pressure $P_3$). In an embodiment, the intermediate injection chamber 144 is at the intermediate pressure. The intermediate injection chamber 144 is discussed in more detail below with respect to FIG. 4.

The discharge chamber 142 is disposed between the compressor housing 102 and the non-orbiting scroll member 112 (e.g., between the upper portion 108A of the compressor housing 102 and the non-orbiting scroll member 112). As shown in FIG. 3, the discharge chamber 142 is a volume defined by the compressor housing 102 and the non-orbiting scroll member 112 (e.g., defined by the upper portion 108A of the compressor housing 102 and the non-orbiting scroll member 112). The discharge chamber 142 may also be referred to as an upper volume of the compressor 100.

The suction chamber 140 is disposed between the compressor housing 102 and the non-orbiting scroll member 112 (e.g., between the lower portion 108B of the compressor housing 102 and the non-orbiting scroll member 112). The suction chamber 140 is disposed opposite to the discharge chamber 142 with respect to the non-orbiting scroll 112. For example, the suction chamber 140 and the discharge chamber 142 are disposed on opposite sides of the non-orbiting scroll 112. As shown in the illustrated embodiment, the discharge chamber 142 and the suction chamber 140 are fluidly separated by the non-orbiting scroll 112. As shown in FIG. 3, the suction chamber 140 is a volume defined by the compressor housing 102 and the non-orbiting scroll member 112 (e.g., defined by the lower portion 108A of the compressor housing 102 and the non-orbiting scroll member 112). The suction chamber 140 may also be referred to as a lower volume of the compressor 100.

As shown in FIG. 3, the intermeshed scrolls 112, 114 have an inlet 124 through which gas flows into the intermeshed scrolls 112, 114. The inlet 124 is formed by/at an outer radius of the spiral wraps 118, 120 (e.g., at the outermost spiral of each spiral wrap 118, 120, at the start of the compression process, not at an intermediate location/compression pocket, or the like). For example, the inlet 124 is at a location at which the compression pockets 116 are initially being formed.

The intermeshed spiral wraps 118, 120 also have outlet 122. The outlet 122 is a port that allows the compressed gas to flow out from between the intermeshed spiral wraps 118, 120. As shown in the illustrated embodiment, the outlet 122 is formed in the baseplate 113 of the non-orbiting scroll. For example, the outlet 122 is located at or near the axial center of the intermeshed spiral wraps 118, 120 (e.g., at or near where the intermeshed spiral wraps 118, 120 end). The outlet 122 is fluidly connected to the discharge chamber 142 of the scroll compressor 100. The compressor 100 may include a valve (e.g., a check valve, a valve plate, or the like) (not shown) to regulate the flow of pressurized gas through the outlet 122.

The compressor 100 includes one or more intermediate injection ports 150 formed in the non-orbiting scroll 112 for injecting intermediate working fluid into the intermeshed scrolls 112, 114. The intermediate injection port(s) 150 fluidly connect the intermediate injection chamber 144 to one or more of the intermediate compression pockets 117 of the intermeshed scrolls 112, 114. The intermediate injection port(s) 150 are configured to inject/direct the intermediate working fluid (i.e., in flow $f_i$) into the intermeshed scrolls 112, 114. An intermediate compression pocket 117 is one of the compression pockets 116 that is partially through the compression process (e.g., at a pressure between the inlet pressure $P_1$ and the discharge pressure $P_2$, has travelled part way and is disposed at an intermediate position between the inlet 124 and the outlet 122). The gaseous and/or liquid intermediate injection working fluid is added to the working fluid already within the intermediate compression pocket 117, which is then further compressed (e.g., to the discharge pressure $P_2$). When the injection working fluid contains liquid working fluid, the liquid working can undergo a pressure drop as its injected into the intermediate compression pocket 117 (e.g., as it flows to the intermediate compression pocket 117, within the intermediate compression pocket 117 that is at relatively lower pressure). The pressure drop can cause evaporation of the working fluid, which provides cooling.

The specific location(s) of the intermediate inlet port(s) 150 with respect to the compression process can be varied. In an embodiment, a location of an intermediate injection port 150 can be located so that the pressure of the intermediate compression pocket 117 is relatively near the suction pressure (e.g., at a location in which compression is just beginning). In the illustrated embodiment, this is a location at a relatively outer extent of the intermeshed scrolls 112, 114 (e.g., relatively closer to the inlet 124, closer to the inlet 124 than the outlet 122). In an embodiment, a location of the intermediate injection port 150 can be selected so that the pressure in the intermediate compression pocket 117 is relatively near the discharge pressure (e.g., at a location near the discharge). In the illustrated embodiment, this is a location at a relatively inner extent of the intermeshed scrolls 112, 114 (e.g., relatively closer to the outlet 122, closer to the outlet 122 than the inlet 124).

For example, the selection of the location(s) of the intermediate inlet port(s) 150 may be selected based on balanced between providing cooling to the compressor 100, increasing capacity of the HVACR system of the compressor 100, and/or maintaining efficiency of the HVACR system of the compressor 100. Such location(s) may be selected based on, for example, modeling the anticipated efficiency and capacity changes, testing to determine the optimal location, or combinations thereof.

The working fluid is compressed by the intermeshed scrolls 112, 114 as the working fluid travels between the intermeshed scrolls 112, 114. The compressed working fluid flows out of the scroll compressor 100 by flowing from the outlet 122 of the intermeshed scrolls 112, 114 to and through the discharge outlet 104B. The working fluid enters the intermeshed scrolls 112, 114 at the relatively lower pressure (e.g., at suction pressure, at the first pressure $P_1$), and is discharged from intermeshed scrolls 112, 114 at a relative higher pressure (e.g., at discharge pressure, at the second pressure $P_2$). The intermediate working fluid at the relatively higher pressure or at the intermediate pressure (e.g., at a pressure between the suction pressure and the discharge pressure, at the third pressure $P_3$) also flows into the intermeshed scrolls 112, 114.

The suction inlet 104A is fluidly connected to the inlet 124 of the intermeshed scrolls 112, 114. The suction flow $f_S$ of the working fluid flows from the suction inlet 104A into the inlet 124 of the intermeshed scrolls 112, 114. As shown in FIG. 3, the suction chamber 140 fluidly connects the suction inlet 104A to the inlet 124 of the intermeshed scrolls 112, 114. For example, the suction inlet 104A fluidly connects to the suction chamber 140, and the suction chamber 140 fluidly connects to the inlet 124 of the intermeshed scrolls 112, 114. The suction chamber 140 is at the suction/inlet pressure of the suction flow $f_S$ (e.g., the working fluid within the suction chamber 140 is at the suction/inlet pressure of the suction flow $f_S$. The intermeshed scrolls 112, 114 configured to suction the working fluid from the suction chamber 140.

The discharge outlet 104B is fluidly connected to the outlet 122 of the intermeshed scrolls 112, 114. The discharge flow $f_D$ of the compressed working fluid flows from outlet 122 of the intermeshed scrolls 112, 114 to and through the discharge outlet 104B of the compressor 100. As shown in FIG. 3, the discharge chamber 142 fluidly connects the outlet 122 of the intermeshed scrolls 112, 114 to the discharge outlet 104B of the compressor 100. For example, the outlet 122 of the intermeshed scrolls 112, 114 fluidly connects to the discharge chamber 142, and the discharge chamber 142 fluidly connects to the discharge outlet 104B of the compressor 100. The compressed working fluid flows from the intermeshed scrolls 112, 114 through the discharge chamber 142 to the discharge outlet 104B of the compressor 100. The discharge chamber 142 is at the discharge pressure (e.g., the working fluid within the discharge chamber 142 is at the discharge pressure of the discharge flow $f_D$).

Figure 4:
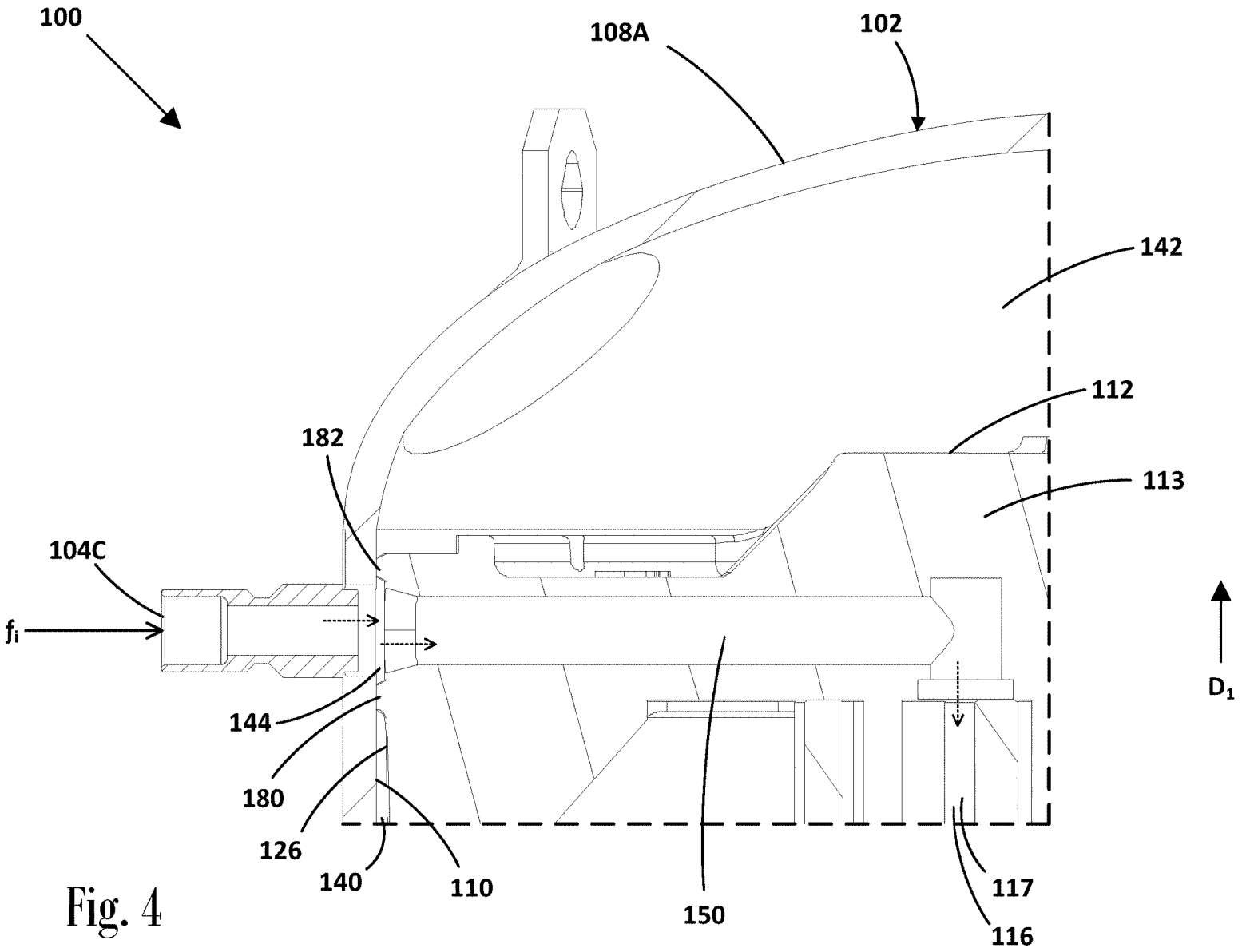
FIG. 4 is a partial vertical cross-sectional view of the scroll compressor in FIG. 2, according to an embodiment.

FIG. 4 is a partial cross-sectional view of the compressor 100 in FIG. 2, according to an embodiment. For example, FIG. 4 is an enlarged portion of the view in FIG. 3. Dashed lines indicate a cutoff of the compressor 100 in the view of FIG. 4. The intermediate injection inlet 104C fluidly connects to the intermediate injection chamber 144. The economizer injection flow $f_i$ (of the intermediate injection working fluid) is directed from the intermediate injection inlet 104C to and through the intermediate injection port 150 into the intermediate compression pocket 117.

As shown in FIG. 4, the intermediate injection chamber 144 fluidly connects the intermediate injection inlet 104C of the compressor 100 to the intermediate injection port 150 in the non-orbiting scroll 112. For example, the intermediate injection inlet 104C fluidly connects to the intermediate injection chamber 144, and the intermediate injection chamber 144 fluidly connects to the intermediate injection port 150 in the non-orbiting scroll 112. The intermediate injection chamber 144 directs the intermediate injection working fluid from the intermediate injection inlet 104C into the intermediate injection port(s) 150 in the non-orbiting scroll 112. The intermediate injection chamber 144 is at the intermediate injection (e.g., the working fluid within the intermediate injection chamber 144 is at the intermediate injection of the economizer injection flow $f_i$).

As shown in FIG. 4, the compressor 100 includes a pair of bands 180, 182 disposed within the housing 102 of the compressor 100. The bands 180, 182 include a first band 180 and a second band 182. The first band 180 may also be referred to as an upper band, and the second band 182 may also be referred to as a lower band. The bands 180, 182 each extend between the non-orbiting scroll 112 and the compressor housing 102. For example, each band 180, 182 extends from the compressor housing 108 to the non-orbiting scroll 112. For example, each band 180, 182 extends from the non-orbiting scroll 112 to the compressor housing 102. In the illustrated embodiment, each band 180, 182 extends between/to the upper portion 108A of the compressor housing 102. Each band 180, 182 forms a respective seal between the upper portion 108A of the compressor housing 102 and the non-orbiting scroll 112.

Figure 6:
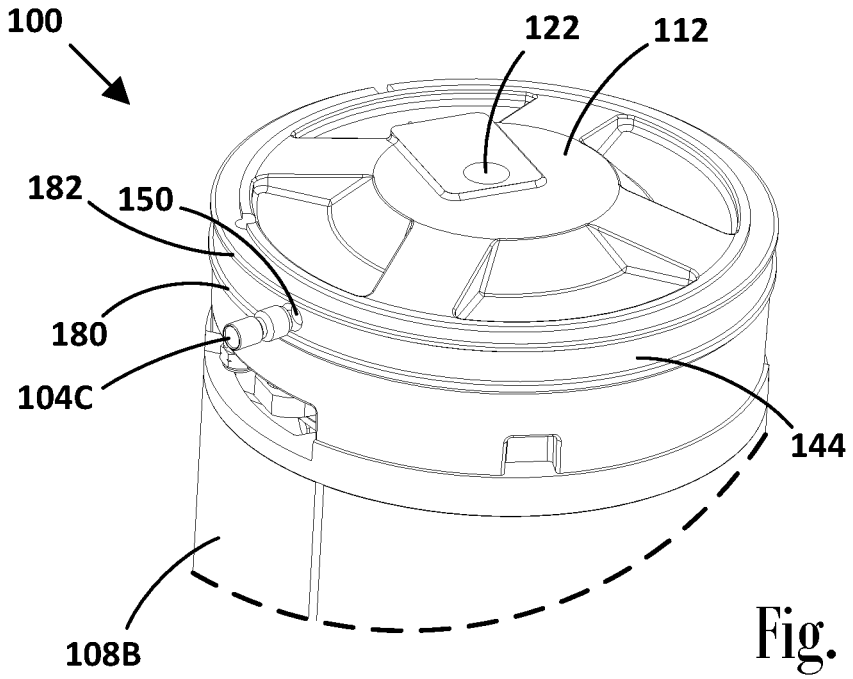
FIG. 6 is a partial front perspective view of the scroll compressor in FIG. 2 with a top portion of a compressor housing of the scroll compressor omitted, according to an embodiment.

Each of the bands 180, 182 extends around a circumference of the non-orbiting scroll 112 (e.g., as shown in FIG. 6). The bands 180, 182 are spaced apart from each other in the axial direction (e.g., in axial direction $D_1$, vertically spaced apart). The intermediate injection chamber 144 is formed by the gap between the bands 180, 182. Said gap is also between the compressor housing 102 and the non-orbiting scroll 112 (e.g., the intermediate injection chamber 114 is formed between the bands 180, 182 and between the compressor housing 102 and the non-orbiting scroll 112).

The intermediate injection chamber 144 is disposed between the compressor housing 102 and the non-orbiting scroll member 112 (e.g., between the upper portion 108A of the compressor housing 102 and the non-orbiting scroll member 112). The intermediate injection chamber 144 is also disposed between the bands 180, 182. The intermediate injection chamber 144 is a volume defined by the compressor housing 102, the non-orbiting scroll member 112, the first band 180 and the second band 182 (e.g., defined by the upper portion 108A of the compressor housing 102, the non-orbiting scroll member 112, the first band 180, and the second band 182). The intermediate injection chamber 144 connects to the intermediate injection port 150 that extends through the non-orbiting scroll member 122 (e.g., intermediate injection port 150 being a passageway/port that extends all the way through the non-orbiting scroll).

The first band 180 forms a seal between the intermediate injection chamber 144 and the suction chamber 140. For example, the first band 180 prevents the working fluid from flowing between the intermediate injection chamber 144 and the suction chamber 140 (e.g., prevents working fluid from flowing directly between the intermediate injection chamber 144 and the suction, prevents the working fluid from flowing directly from the suction chamber 144 into the suction chamber 140). The first band 180 defines the suction chamber 140.

The second band 182 forms a seal between the intermediate injection chamber 144 and the discharge chamber 142. For example, the second band 182 prevents the working fluid from flowing between the intermediate injection chamber 144 and the discharge chamber 142 (e.g., prevents working fluid from flowing directly between the intermediate injection chamber 144 and discharge chamber 142, prevents the working fluid from flowing directly from the discharge chamber 142 into the intermediate injection chamber 144). The second band 182 defines the discharge chamber 142.

The upper portion 108A of the compressor housing 102 is interference fit onto the non-orbiting scroll 112 via the bands 180, 182. For example, interference fit refers to fit between features/components in which the friction between the components prevents movement of the features/components relative to each other. In an embodiment, the interference fit of the upper portion 108A onto the non-orbiting scroll 112 is a shrink fit (e.g., formed by shrink fitting). Shrink fitting is an example of one manner of forming the interference fit. The interference/friction fit is formed by shrink fitting the upper portion 108A of the compressor housing 102 onto the non-orbiting scroll 112 via the bands 180, 182. In such an embodiment, the bands 180, 182 are shrink bands. For example, the upper portion 108A is heated to fit onto/around the non-orbiting scroll 112 (e.g., the heated upper portion 108A is placed over/onto/around the non-orbiting scroll 112), and then is cooled (e.g., air cooled, cooled using cooled air/gas, or the like) causing shrinking of the upper portion 108A and onto the shrink bands 180, 182. The shrinking/cooling of the upper portion 108A causing an interference fit between the upper portion 108A of the compressor housing 102 and the non-orbiting scroll 112 via the shrink bands 180, 182. Shrink fitting can advantageously form the interference fit without generating debris (e.g., scraping of surfaces against each other generates debris) that can damage the compressor. Shrink fitting can also advantageously ensure a seal is formed at each of the bands 180, 182 between the upper portion 108A of the compressor housing 102 and the non-orbiting scroll 112.

In an embodiment, the interference fit of the upper portion 108A is a press fit onto the upper portion 108A onto the non-orbiting scroll 112. For example, press fitting may include the upper portion 108A being molded/deformed (e.g., radially inward) onto the non-orbiting scroll 112. The compressor 100 may also include fasteners (e.g., bolts, screws, or the like) (not shown) that help maintain the position of the upper portion 108A of compressor housing 102 (e.g., prevent axial movement, prevent upwards) on the non-orbiting scroll member 112.

Figure 5:
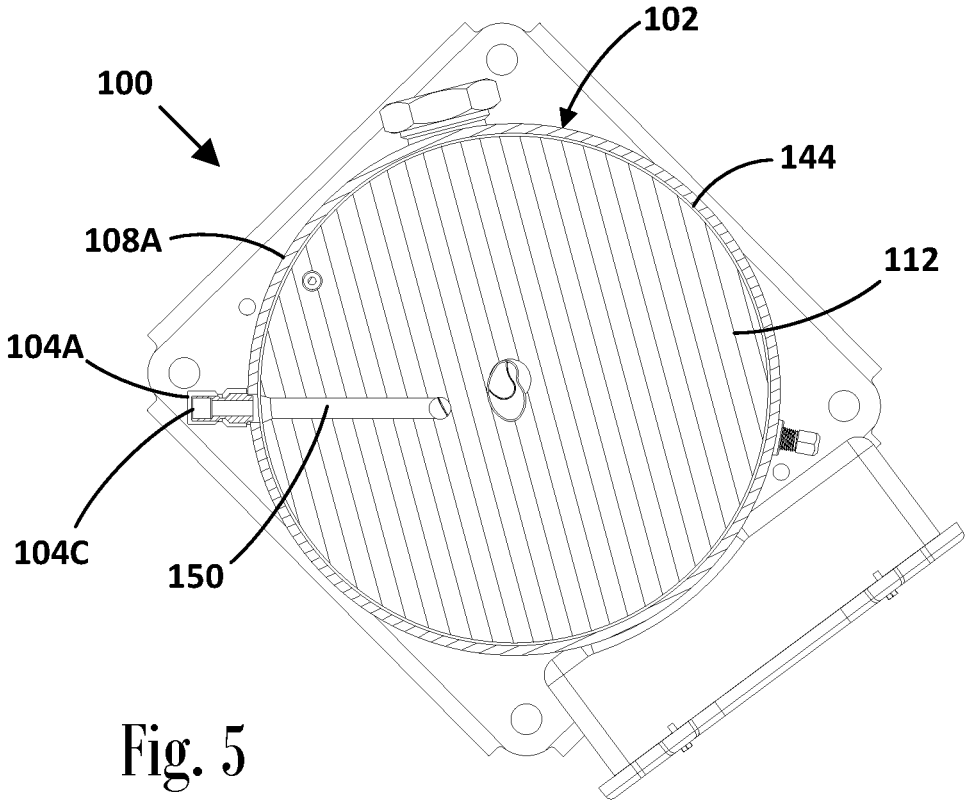
FIG. 5 is a horizontal cross-sectional view of the scroll compressor as indicated in FIG. 3, according to an embodiment.

FIG. 5 is a cross-sectional view of the compressor 100, according to an embodiment. For example, the cross-sectional view is a horizontal cross-sectional view of the compressor 100 as indicated in FIG. 4. FIG. 6 is a partial front perspective view of the compressor 100, with the upper portion 108A of the housing 102 omitted.

As shown in FIG. 5, the intermediate injection chamber 144 surrounds the non-orbiting scroll 112. For example, the intermediate injection chamber 144 has an annular shape. The annular shape may be circular (e.g., see FIG. 5), oval, rectangular, etc. In the illustrated embodiment, the intermediate injection inlet 104C is radially aligned with the intermediate injection port 150. In an embodiment, the intermediate injection inlet 104C may be radially offset from the intermediate injection port 150. For example, the inlet opening for the intermediate injection inlet 104C and the outlet opening for the intermediate injection port 150 may partially overlap in the radial direction or may not overlap in the radial direction. In one such embodiment, the non-orbiting scroll 112 may include multiple intermediate injection ports 150, and the intermediate injection chamber 144 can fluidly connect the intermediate injection inlet 104C to the multiple intermediate injection ports 150.

As shown in FIGS. 5 and 6, each of the bands 180, 182 encircles the non-orbiting scroll 112. Each of the bands 180, 182 can have an annular shape (e.g., a ring shape). The first band 180 and the second band 182 are spaced apart from each other forming the intermediate injection chamber 144 therebetween. The intermediate injection chamber 144 encircles the non-orbiting scroll 112. The intermediate injection chamber 144 has an annular shape.

The bands 180, 182 may each be included in the non-orbiting scroll 112, in the housing 102, or as a separate component. In the illustrated embodiment, the bands 180, 182 are portions of the non-orbiting scroll 112. For example, the bands 180, 182 are provided as extensions from the baseplate 113 of the non-orbiting scroll 112 (e.g., extend from the baseplate 113 of the non-orbiting scroll 112, the baseplate 113 of the non-orbiting scroll 112 is formed to include the bands 180, 182). The bands 180, 182 may be provided on/extend from an outer circumferential surface 126 of the non-orbiting scroll 112 (e.g., an outer circumferential surface 126 of the baseplate 113 of the non-orbiting scroll 112).

The bands 180, 182 can be made of any suitable material (e.g., able to be pressed to form the interference fit, able to withstanding the temperatures used in shrink fitting, able to withstand the pressure and/or temperatures that occur during operation of the compressor, and the like). For example, a band 180, 182 may be a metal ring (e.g., a copper ring, or the like) that is fit onto the outer circumference of the non-orbiting scroll 112 (e.g., onto the outer circumference of the baseplate 113 of the non-orbiting scroll 112). For example, a band 180, 182 may be a metal ring that is fit on the inner surface/circumference of the upper portion 108A of the compressor housing 102. For example, a band may be a crush ring (e.g., metal crush ring) that is provided between the upper portion 108A of the compressor housing 102 and the non-orbiting scroll 112 and is crush fit into place. For example, a band may be made of a polymer material (e.g., modified polymer) that is capable of withstanding the fitting conditions/temperatures.

In an embodiment, one or both of the bands 180, 182 may be provided on an inner surface 110 of the housing 102 (see FIG. 4), an outer surface of the non-orbiting scroll 112 (e.g., outer circumferential surface 126), and/or as a separate component from the non-orbiting scroll 112 and the housing 102. In an embodiment, the bands 180, 182 may be included in both of the non-orbiting scroll 112 and the housing 102 (e.g., one band 180, 182 included in the non-orbiting scroll 112 and the other band 180, 182 included in the housing 102).

Figure 7:
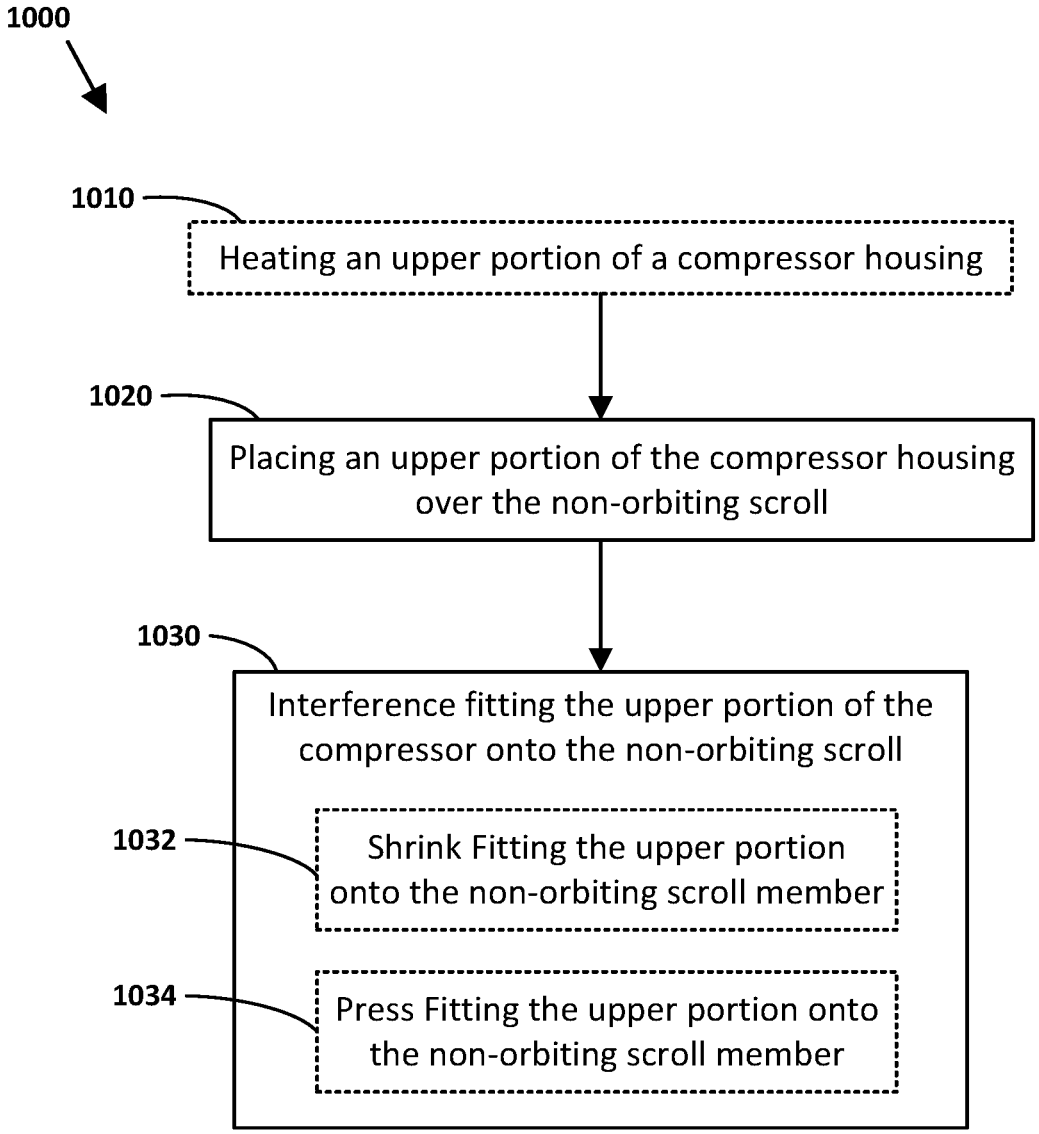
FIG. 7 is a block flow diagram of an embodiment of making a scroll compressor.

FIG. 7 is a block flow diagram for a method 1000 of making a scroll compressor. For example, the method 1000 employed to make the scroll compressor 100 in FIGS. 2-6. The method 1000 can start at 1010 or 1020.

At 1010, an upper portion (e.g., upper portion 108A) of a compressor housing (e.g., compressor housing 102) is heated. The upper portion is heated at 1010 to a temperature above ambient temperature (e.g., above 70° F.). The heating 1010 causes the upper portion to expand. In particular, the heating 1010 causes an inner diameter of the upper portion to increase. The increased inner diameter of the upper portion is at least equal to a diameter of a non-orbiting scroll (e.g., non-orbiting scroll 112) and bands (e.g., bands 180, 182) of the compressor. In an embodiment, the increased inner diameter of the upper portion 108A is greater than the diameter of the non-orbiting scroll 112 and the shrink bands 180, 182. The method 1000 then proceeds to 1020.

At 1020, the upper portion of the compressor housing is placed over the non-orbiting scroll, with the bands each being disposed between the upper portion of the compressor housing and the non-orbiting scroll. The upper portion of the compressor housing is placed over the non-orbiting scroll such that the upper portion of the compressor housing surrounds the non-orbiting scroll. For example, the non-orbiting scroll and the bands being disposed within the upper portion of the compressor housing. The method 1000 then proceeds to 1030.

At 1030, the upper portion of the compressor housing is interference fit onto the non-orbiting scroll member via the bands. The interference fitting at 1030 forms an intermediate injection chamber (e.g., intermediate injection chamber 144) within the compressor housing. The bands define the intermediate injection chamber. The interference fitting at 1030 can also form a discharge chamber (e.g., discharge chamber 142) within the compressor housing. In an embodiment, the interference fitting also forms a suction chamber (e.g., suction chamber 140) within the compressor housing. For example, the shrink bands also define the discharge chamber and/or the suction chamber within the compressor.

In an embodiment, the interference fitting at 1030 is shrink fitting 1032 of the upper portion of the compressor housing onto the non-orbiting scroll member 1032. In such an embodiment, the method 1000 starts at 1010. At 1032, the upper portion of the compressor housing is cooled to shrink fit the upper portion onto the non-orbiting scroll member 1032. The upper portion is cooled while containing the non-orbiting scroll and bands (e.g., while placed around/surrounding the non-orbiting scroll and bands). The cooling at 1030 results in the shrink fitting of the upper portion of the compressor housing onto the non-orbiting scroll via the bands. For example, the cooling of the relatively hot/heated upper portion at 1030 causes the upper portion to shrink, and said shrinking fits/affixes the upper portion onto non-orbiting scroll via the bands. Said shrinking results in an interference fit between the upper portion of the compressor housing and the non-orbiting scroll via each of the shrink bands.

In an embodiment, the interference fitting at 1030 is press fitting 1034 of the upper portion of the compressor housing onto the non-orbiting scroll member 1032. In such an embodiment, the method 1000 can start at 1020. At 1032, the upper portion of the compressor housing is pressed onto the upper portion onto the non-orbiting scroll member. For example, the upper portion of the compressor housing is molded/deformed onto the bands and the non-orbiting scroll member. For example, fasteners (e.g., bolts, screws, or the like) may be used to help with maintaining the upper portion of compressor housing affixed in place on the non-orbiting scroll member.

It should be appreciated that the method 1000 may be modified to include features as shown for the compressor 100 in FIGS. 2-6.

Aspects:

Any of Aspects 1-10 may be combined with any of Aspects 11-19, and any of Aspects 11-16 may be combined with any of Aspects 17-19.

Aspect 1. A scroll compressor, comprising: a compressor housing containing a suction chamber, a discharge chamber, and an intermediate injection chamber; an orbiting scroll member and a non-orbiting scroll member intermeshed to form compression pockets within the compressor housing, the compression pockets configured to suction from the suction chamber and discharge into the discharge chamber, the non-orbiting scroll member including an intermediate injection port fluidly connecting the intermediate injection chamber to at least one of the compression pockets; and a first band and a second band disposed within the compressor housing and each extending between the non-orbiting scroll member and the compressor housing, the intermediate injection chamber being defined by the first band and the second band.

Aspect 2. The scroll compressor of Aspect 1, wherein the first band forms a seal between the intermediate injection chamber and the discharge chamber, and the second band forms a seal between the intermediate injection chamber and the suction chamber.

Aspect 3. The scroll compressor of any one of Aspects 1 and 2, wherein a first band and a second band each extend from the non-orbiting scroll member to the compressor housing.

Aspect 4. The scroll compressor of any one of Aspects 1-3, further comprising: a suction inlet in the compression housing, the suction chamber fluidly connecting the suction inlet to an inlet of the compression pockets, a discharge outlet in the compression housing, the discharge chamber fluidly connecting an outlet of the compression pockets to the discharge outlet, and an intermediate injection inlet in the compression housing, the intermediate injection chamber fluidly connecting the intermediate injection inlet to intermediate injection port in the non-orbiting scroll member.

Aspect 5. The scroll compressor of any one of Aspects 1-4, wherein the intermediate injection chamber encircles the non-orbiting scroll member.

Aspect 6. The scroll member of any one of Aspects 1-5, wherein the first band and the second band each encircle the non-orbiting scroll member.

Aspect 7. The scroll compressor of any one of Aspects 1-6, wherein the intermediate injection chamber has an annular shape.

Aspect 8. The scroll compressor of any one of Aspects 1-7, wherein the compressor housing includes an upper portion and a lower portion, the first band extending from the non-orbiting scroll member to the upper portion of the compressor housing, the intermediate injection chamber being defined by the upper portion of the compressor housing.

Aspect 9. The scroll member of Aspect 8, wherein the upper portion of the compressor housing is shrink fitted onto the non-orbiting scroll member via the first band and the second band.

Aspect 10. The scroll compressor of any one of Aspects 1-9, wherein the first band contacts the compressor housing and the non-orbiting scroll member.

Aspect 11. A heating, ventilation, air conditioning, and refrigeration (HVACR) system, comprising: a refrigerant circuit including a condenser, a plurality of expanders, an evaporator, and a scroll compressor fluidly connected, a working fluid flowing through the refrigerant circuit, wherein the scroll compressor includes: a compressor housing containing a suction chamber, a discharge chamber, and an intermediate injection chamber, an orbiting scroll member and a non-orbiting scroll member intermeshed to form compression pockets within the compressor housing, the compression pockets configured to suction from the suction chamber and discharge into the discharge chamber, the non-orbiting scroll member including an intermediate injection port fluidly connecting the intermediate injection chamber to at least one of the compression pockets, and a first band and a second band each extending between the non-orbiting scroll member and the compressor housing, the intermediate injection chamber being defined by the first band and the second band.

Aspect 12. The HVACR of Aspect 11, wherein the first band forms a seal between the intermediate injection chamber and the discharge chamber, and the second band forms a seal between the intermediate injection chamber and the suction chamber.

Aspect 13. The HVACR of any one of Aspects 11 and 12, wherein the first band and the second band each extend from the non-orbiting scroll member to the compressor housing.

Aspect 14. The HVACR of any one of Aspects 11-13, wherein the scroll compressor includes: a suction inlet in the compression housing, the suction chamber fluidly connecting the suction inlet to an inlet of the compression pockets, a discharge outlet in the compression housing, the discharge chamber fluidly connecting an outlet of the compression pockets to the discharge outlet, and an intermediate injection inlet in the compression housing, the intermediate injection chamber fluidly connecting the intermediate injection inlet to intermediate injection port in the non-orbiting scroll member.

Aspect 15. The HVACR of any one of Aspects 11-14, wherein the intermediate injection chamber encircles the non-orbiting scroll member.

Aspect 16. The HVACR of any one of Aspects 11-15, wherein the first band and the second band each encircle the non-orbiting scroll member.

Aspect 17. A method of making a scroll compressor, comprising: placing an upper portion of a compressor housing over a non-orbiting scroll member, the upper portion of the compressor housing surrounding the non-orbiting scroll member, and a first band and a shrink band each being disposed between the upper portion of the compressor housing and the non-orbiting scroll member; and interference fitting the upper portion of the compressor housing onto the non-orbiting scroll member via the first band and the second band, wherein the interference fitting forms an intermediate injection chamber defined by the first band, the second band, the upper portion of the compressor housing, and the non-orbiting scroll member, the intermediate injection chamber fluidly connecting an intermediate injection inlet in the compressor housing to an intermediate injection port in the non-orbiting scroll member.

Aspect 18. The method of claim 17, further comprising: heating of the upper portion of the compressor housing, prior to placing the upper portion of the compressor housing onto the non-orbiting scroll member, wherein the interference fitting is a shrinking fitting that includes cooling of the upper portion of the compressor housing, which results in the upper portion of the compressor housing being shrink fit onto the non-orbiting scroll member via the first band the second band, the first band and the second band being shrink bands.

Aspect 19. The method of any one of Aspects 17 and 18, wherein the scroll compressor includes a non-orbiting scroll member intermeshed with the non-orbiting scroll member to form compression pockets, and the interference fitting forms a discharge chamber that fluidly connects an outlet of the compression pockets to the discharge outlet.

The terminology used herein is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components. In an embodiment, "connected" and "connecting" as described herein can refer to being "directly connected" and "directly connecting".

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

What is claimed is:

1. A scroll compressor, comprising:

a compressor housing containing a suction chamber, a discharge chamber, and an intermediate injection chamber;

an orbiting scroll member and a non-orbiting scroll member intermeshed to form compression pockets within the compressor housing, the compression pockets configured to suction from the suction chamber and discharge into the discharge chamber, the non-orbiting scroll member including an intermediate injection port fluidly connecting the intermediate injection chamber to at least one of the compression pockets; and a first band and a second band disposed within the compressor housing and each extending between the non-orbiting scroll member and the compressor housing, the intermediate injection chamber being defined by the first band and the second band.

2. The scroll compressor of claim 1, wherein the first band forms a seal between the intermediate injection chamber and the discharge chamber, and the second band forms a seal between the intermediate injection chamber and the suction chamber.

3. The scroll compressor of claim 1, wherein the first band and the second band each extend from the non-orbiting scroll member to the compressor housing.

4. The scroll compressor of claim 1, further comprising:

a suction inlet in the compression housing, the suction chamber fluidly connecting the suction inlet to an inlet of the compression pockets, a discharge outlet in the compression housing, the discharge chamber fluidly connecting an outlet of the compression pockets to the discharge outlet, and an intermediate injection inlet in the compression housing, the intermediate injection chamber fluidly connecting the intermediate injection inlet to the intermediate injection port in the non-orbiting scroll member.

5. The scroll compressor of claim 1, wherein the intermediate injection chamber encircles the non-orbiting scroll member.

6. The scroll compressor of claim 1, wherein the first band and the second band each encircle the non-orbiting scroll member.

7. The scroll compressor of claim 1, wherein the intermediate injection chamber has an annular shape.

8. The scroll compressor of claim 1, wherein the compressor housing includes an upper portion and a lower portion, the first band extending from the non-orbiting scroll member to the upper portion of the compressor housing, the intermediate injection chamber being defined by the upper portion of the compressor housing.

9. The scroll member of claim 8, wherein the upper portion of the compressor housing is shrink fitted onto the non-orbiting scroll member via the first band and the second band.

10. The scroll compressor of claim 1, wherein the first band contacts the compressor housing and the non-orbiting scroll member.

11. A heating, ventilation, air conditioning, and refrigeration (HVACR) system, comprising:

a refrigerant circuit including a condenser, at least one expander, an evaporator, and a scroll compressor fluidly connected, a working fluid flowing through the refrigerant circuit, wherein the scroll compressor includes:

a compressor housing containing a suction chamber, a discharge chamber, and an intermediate injection chamber, an orbiting scroll member and a non-orbiting scroll member intermeshed to form compression pockets within the compressor housing, the compression pockets configured to suction from the suction chamber and discharge into the discharge chamber, the non-orbiting scroll member including an intermediate injection port fluidly connecting the intermediate injection chamber to at least one of the compression pockets, and a first band and a second band each extending between the non-orbiting scroll member and the compressor housing, the intermediate injection chamber being defined by the first band and the second band.

12. The HVACR of claim 11, wherein the first band forms a seal between the intermediate injection chamber and the discharge chamber, and the second band forms a seal between the intermediate injection chamber and the suction chamber.

13. The HVACR of claim 11, wherein the first band and the second band each extend from the non-orbiting scroll member to the compressor housing.

14. The HVACR of claim 11, wherein the scroll compressor includes:

a suction inlet in the compression housing, the suction chamber fluidly connecting the suction inlet to an inlet of the compression pockets, a discharge outlet in the compression housing, the discharge chamber fluidly connecting an outlet of the compression pockets to the discharge outlet, and an intermediate injection inlet in the compression housing, the intermediate injection chamber fluidly connecting the intermediate injection inlet to the intermediate injection port in the non-orbiting scroll member.

15. The HVACR of claim 11, wherein the intermediate injection chamber encircles the non-orbiting scroll member.

16. The HVACR of claim 11, wherein the first band and the second band each encircle the non-orbiting scroll member.

17. A method of making a scroll compressor, comprising:

placing an upper portion of a compressor housing over a non-orbiting scroll member, the upper portion of the compressor housing surrounding the non-orbiting scroll member, and a first band and a second band each being disposed between the upper portion of the compressor housing and the non-orbiting scroll member; and interference fitting the upper portion of the compressor housing onto the non-orbiting scroll member via the first band and the second band, wherein the interference fitting forms an intermediate injection chamber defined by the first band, the second band, the upper portion of the compressor housing, and the non-orbiting scroll member, the intermediate injection chamber fluidly connecting an intermediate injection inlet in the compressor housing to an intermediate injection port in the non-orbiting scroll member.

18. The method of claim 17, further comprising:

heating of the upper portion of the compressor housing, prior to placing the upper portion of the compressor housing onto the non-orbiting scroll member, wherein the interference fitting is a shrinking fitting that includes cooling of the upper portion of the compressor housing, which results in the upper portion of the compressor housing being shrink fit onto the non-orbiting scroll member via the first band the second band, the first band and the second band being shrink bands.

19. The method of claim 17, wherein the scroll compressor includes an orbiting scroll member intermeshed with the non-orbiting scroll member to form compression pockets, and the interference fitting forms a discharge chamber that fluidly connects an outlet of the compression pockets to a discharge outlet in the compressor housing.

* * * * *